US010682783B2

(12) United States Patent
Yang

(10) Patent No.: US 10,682,783 B2
(45) Date of Patent: Jun. 16, 2020

(54) LIGHT-WEIGHT SPACER FOR A SLITTING MACHINE

(71) Applicant: NIREI CORPORATION LTD., Pingtung, Pingtung County (TW)

(72) Inventor: Cho-Ching Yang, Pingtung (TW)

(73) Assignee: NIREI CORPORATION LTD., Pingtung (TW)

( * ) Notice: Subject to any disclaimer, the term of this patent is extended or adjusted under 35 U.S.C. 154(b) by 126 days.

(21) Appl. No.: 15/487,891

(22) Filed: Apr. 14, 2017

(65) Prior Publication Data

US 2017/0368709 A1 Dec. 28, 2017

(30) Foreign Application Priority Data

Jun. 28, 2016 (TW) ..... 105120284 A

(51) Int. Cl.
*B26D 7/26* (2006.01)
*B26D 3/12* (2006.01)
*B26D 1/24* (2006.01)

(52) U.S. Cl.
CPC ..... *B26D 7/2621* (2013.01); *B26D 3/12* (2013.01); *B26D 1/245* (2013.01)

(58) Field of Classification Search
CPC ..... Y10T 83/6584; Y10T 83/6588; Y10T 83/6587; Y10T 83/659; B26D 7/2621; B26D 7/26; B26D 7/2614; B26D 7/2628; B26D 7/2635; B26D 3/12; B26D 1/245; B26D 1/01; B26D 1/015; B26D 1/12; B26D 1/125; B26D 1/14; B26D 1/141; B26D 1/143; B26D 1/1435; B26D 1/24
See application file for complete search history.

(56) References Cited

U.S. PATENT DOCUMENTS 2,613,571 A * 10/1952 Herman ..... B26D 7/2621 384/626
4,429,837 A * 2/1984 Knecht ..... B02C 18/20 241/282.2
4,805,506 A * 2/1989 Gosnell ..... B23D 19/06 83/347
D339,814 S * 9/1993 Pepper ..... D15/138
6,450,075 B1 * 9/2002 Manzo ..... B23D 59/02 83/171
2004/0060408 A1 * 4/2004 Thomas ..... B23D 35/007 83/425.3

* cited by examiner

*Primary Examiner* — Phong H Nguyen
(74) *Attorney, Agent, or Firm* — Birch, Stewart, Kolasch & Birch, LLP

(57) ABSTRACT

The present invention provides a light-weight spacer for a slitting machine for maintaining the width between slitting knives. The light-weight spacer comprises: a spacer body having a ring structure integrally formed of metal; an inner surface positioned on the inner side of the ring structure and extending along the central axis of the ring structure; an outer surface positioned on the outer side of the ring structure and extending along the central axis of the ring structure; a first side surface extending between the inner surface and the outer surface and being perpendicular thereto; a second side surface opposite to the first side surface and extending between the inner surface and the outer surface; a first plurality of perforations provided on the first side; and a second plurality of perforations provided on the second side.

6 Claims, 5 Drawing Sheets

LIGHT-WEIGHT SPACER FOR A SLITTING MACHINE

BACKGROUND OF THE INVENTION

Field of the Invention

The present invention relates to a light-weight spacer, and more particularly, to a light-weight spacer for a slitting machine.

Description of the Prior Art

A slitting machine (or a slitting line) is used to cut a wide-width material into a plurality of narrow-width pieces; it cuts materials such as metal, cloth, paper and plastics, and the wide-width material to be cut is generally in the form of a roll (such as a thin steel roll). Conventionally, a wide-width material in the form of a roll is set on an uncoiler (or an unwinding or unreeling machine) to unwind the roll, and after being cut by slitting knives, the wide-width material turns into slit rolls which are sent to a recoiler (or a rewinding machine) to reel into a plurality of narrow-width rolls.

A slitting knife is commonly in a circular-ring shape and can fit onto an arbor; meanwhile, a plurality of slitting knives can be fit onto the arbor, and the cutting width can be adjusted based on cutting demands. Adjusting the cutting width can be done by mounting spacers (or separators, knives spacers, slitter spacers) having the desired cutting width onto the arbor, in order to keep the slitting knives fixed at the desired positions of the arbor for cutting the desired width.

Conventionally when a technician is adjusting the cutting width of a slitting machine, the technician needs to repeatedly set up and remove the spacers. However, the weight of a spacer is quite heavy. For instance, a spacer with an OD (outside diameter) of 35 cm and a width of 5 cm weighs about 10 kg; a spacer with an OD of 27 cm and a width of 5 cm weighs about 7.5 kg. Therefore, it takes a technician much time and effort to adjust the cutting width, which further affects the processing time of a slitting machine and the overall production efficiency.

SUMMARY OF THE INVENTION

In view of the above-described problems in the prior art, an object of the invention is to provide a light-weight spacer used in a slitting machine. By improving the structure of the spacer, it will save the energy and time for technicians in adjusting cutting widths. On the other hand, the light-weight spacer according to this invention can maintain the structural strength and precision while reducing the weight of the spacer.

According to one embodiment of the invention, a light-weight spacer for a slitting machine for maintaining a width between slitting knives comprises: a spacer body having a ring structure integrally formed of metal; an inner surface, positioned on an inner side of the ring structure and extending along a central axis of the ring structure; an outer surface, positioned on an outer side of the ring structure and extending along the central axis of the ring structure; a first side surface, extending between the inner surface and the outer surface and being perpendicular thereto; a second side surface, extending between the inner surface and the outer surface and being opposite to the first side surface; a first plurality of perforations provided on the first side surface, and a second plurality of perforations provided on the second side surface.

According to another embodiment of this invention, a light-weight spacer for a slitting machine for maintaining a width between slitting knives comprises: a spacer body having a ring structure integrally formed of metal; an inner surface, positioned on an inner side of the ring structure and extending along a central axis of the ring structure; an outer surface, positioned on an outer side of the ring structure and extending along the central axis of the ring structure; a first side surface, extending between the inner surface and the outer surface and being perpendicular thereto; a second side surface, extending between the inner surface and the outer surface and being opposite to the first side surface, wherein the first side surface and the second side surface have a plurality of recesses respectively, and the recesses on the first side surface have identical dimensions as the recesses on the second side surface.

According to yet another embodiment of this invention, a light-weight spacer for a slitting machine for maintaining a width between slitting knives comprises: a spacer body having a ring structure integrally formed of a polymer; an inner surface, positioned on an inner side of the ring structure and extending along a central axis of the ring structure; an outer surface, positioned on an outer side of the ring structure and extending along the central axis of the ring structure; a first side surface, extending between the inner surface and the outer surface and being perpendicular thereto; a second side surface, extending between the inner surface and the outer surface and being opposite to the first side surface; a first plurality of perforations provided on the first side surface; a second plurality of perforations provided on the second side surface; a plurality of metal blocks respectively disposed in the first plurality of perforations and the second plurality of perforations, the plurality of metal blocks having a height that exceeds the first side surface and the second side surface.

In view of the above embodiments, this invention provides a structural improvement to a light-weight spacer to effectively reduce the weight of the spacer and enable technicians to change spacers faster when adjusting the cutting width, so as to enhance the productive performance of the slitting machine. The perforations of this invention are designed to be in an arched shape, the radian of which is the same as the radian of the ring structure, which can sustain greater pressure structurally.

As for other additional features and advantages of this invention, it should be noted that various modifications and alterations can be made by persons skilled in the art without departing from the spirit and scope of the invention.

DETAILED DESCRIPTION OF PREFERRED EMBODIMENTS

The present invention now will be described more fully hereinafter with reference to the accompanying drawings, in which preferred embodiments of the invention are shown. It is to be understood that all kinds of alterations and changes can be made by those skilled in the art without deviating from the spirit and the scope of the invention. This description is not to be taken in a limiting sense, but is made merely for the purpose of illustrating the general principles of the invention.

Figure 1:
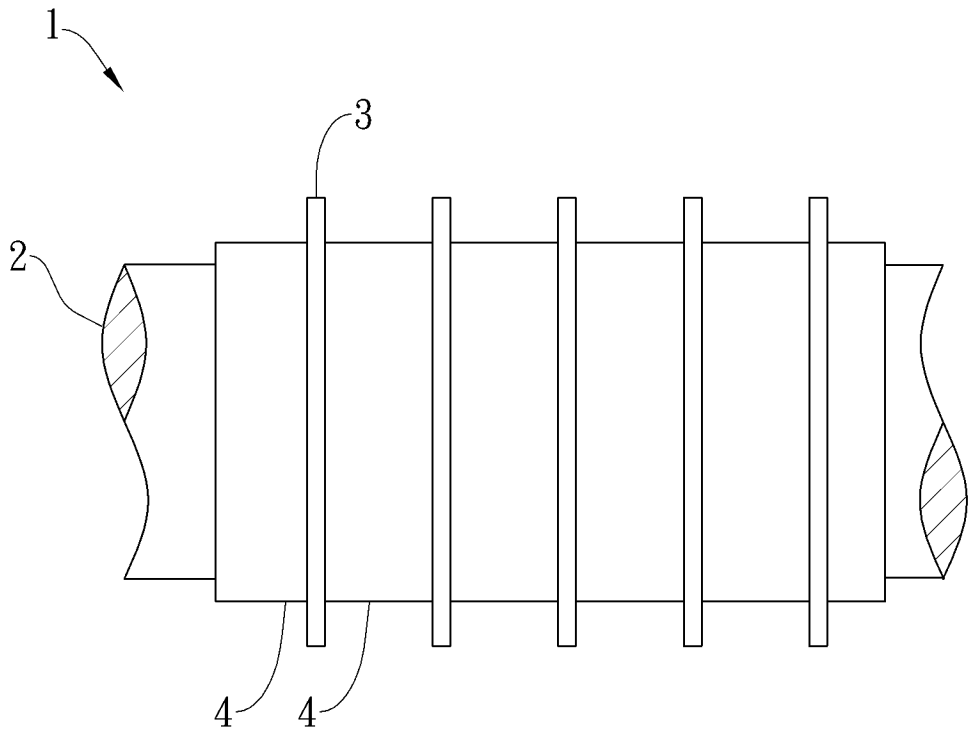
FIG. 1 is a schematic view showing an arbor structure of a slitting machine.

FIG. 1 illustrates an arbor structure 1 of a slitting machine. The arbor structure 1 of a slitting machine comprises an arbor 2, slitting knives 3, and spacers 4.

In FIG. 1, a plurality of slitting knives 3 fit snugly onto the arbor 2, and a plurality of spacers 4 fit between the slitting knives 3 and onto both sides of the arbor 2 to control the cutting width for cutting a wide-width material. The width of the spacer 4 depends on the desired cutting size, but the dimensions of the spacer 4 are flexible. For example, if the desired cutting width between two slitting knives 3 is 20 cm, then four spacers 4 of 5 cm in width may be used, or five spacers 4 of 4 cm in width may be used. To avoid the idling of the spacers 4 while the arbor 2 is rotating, or a difference in rotating speed between the spacers 4 and the arbor 2, the contact surfaces of the arbor 2 and the spacer 4 are usually designed to be in a concave and convex form to engage each other.

Figure 2:
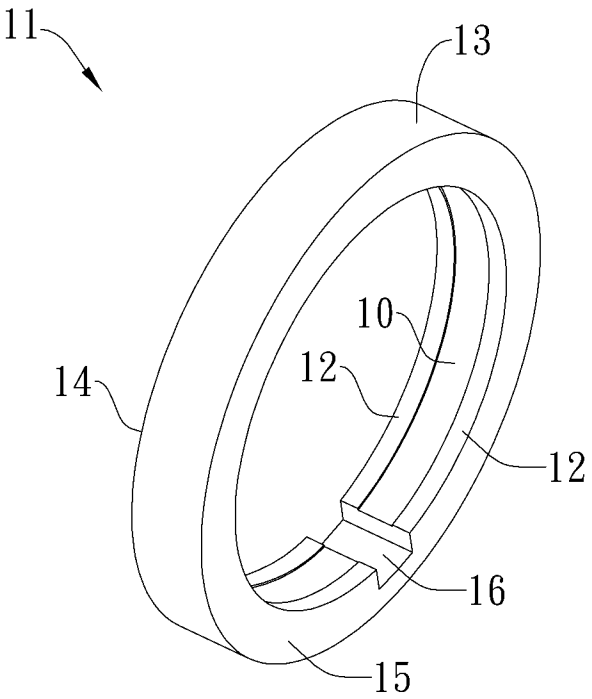
FIG. 2 is a perspective view of a conventional spacer.

FIG. 2 illustrates a perspective view of a conventional spacer. A spacer body 11 comprises an inner surface 12, an outer surface 13, a first side surface 14, a second side surface 15 and a keyway 16.

In FIG. 2, the inner surface 12 and the outer surface 13 of a conventional spacer are concentric and share the same axis, and the inner surface 12 may have a groove 10 for the purpose of reducing weight. The first side surface 14 and the second side surface 15 are two smooth surfaces parallel to each other. The keyway 16 is provided on the inner surface 12 and is used for securing the spacer body 11 on the arbor to allow both the spacer and the arbor to rotate simultaneously.

Figure 3:
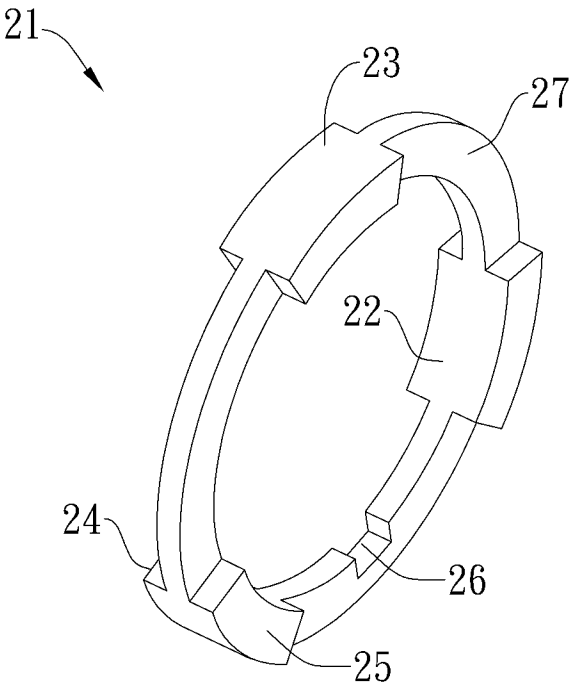
FIG. 3 is a perspective view of a light-weight spacer according to the first embodiment of this invention.

FIG. 3 is a perspective view of a light-weight spacer according to the first embodiment of this invention. As FIG. 3 shows, a spacer body 21 comprises an inner surface 22, an outer surface 23, a first side surface 24, a second side surface 25, a keyway 26 and a plurality of recesses 27.

In the first embodiment, the spacer body 21 has a ring structure, which may be integrally formed of metal or formed by joining/combining metals together (such as medium carbon steel, S45C steel, SCM440 steel, SUJ2 steel, tool steel, stainless steel plate, aluminum alloy steel or various alloy steels). The inner surface 22 is positioned on the inner side of the ring structure; the outer surface 23 is positioned on the outer side of the ring structure. The inner surface 22 and the outer surface 23 are parallel to each other and both extend along the central axis of the ring structure. The first side surface 24 and the second side surface 25 both extend between the inner surface 22 and the outer surface 23, and are perpendicular to the inner surface 22 and the outer surface 23, wherein the second side surface 25 is opposite to the first side surface 24.

In the first embodiment, a plurality of recesses 27 on the first side surface 24 and the second side surface 25 are evenly distributed on the spacer body 21 and are used to reduce the weight of the spacer body 21. Polymers (such as plastic steel, ABS, PC, POM, PBT, or any polymer combination) may be used to fill in the plurality of recesses 27 to form a plurality of filler portions. The filler portions on the recesses 27 may improve the outlook of the spacer body 21, wherein the dimensions of each filler portion do not exceed the inner surface 22, the outer surface 23, the first side surface 24, and the second side surface 25. The total number and dimensions of the recesses 27 are not limited to those described in this embodiment. For example, the number of the recesses 27 may be increased to 6, 8, or 10 to further increase the number of metal blocks between the recesses 27. When the number of metal blocks between the recesses 27 increases, the volume of each metal block becomes smaller accordingly. The keyway 26 is disposed on the inner surface 22. The keyway 26 may be arranged at any position on the inner surface 22 and extends along the central axis of the ring structure. In addition, the first side surface 24 and the second side surface 25, which are parallel to each other, extend between the inner surface 22 and the outer surface 23 and are perpendicular to them.

Figure 4:
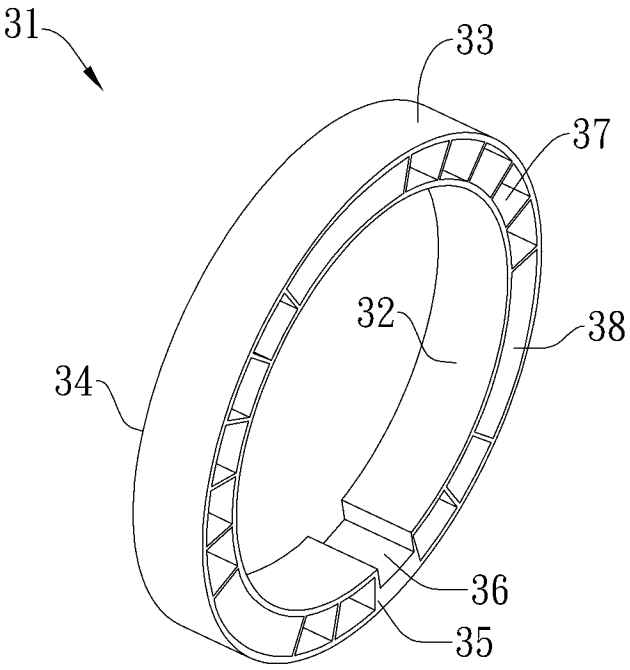
FIG. 4 is a perspective view of a light-weight spacer according to the second embodiment of this invention.

FIG. 4 is a perspective view of the second embodiment of the light-weight spacer of this invention. As shown in FIG. 4, a spacer body 31 comprises an inner surface 32, an outer surface 33, a first side surface 34, a second side surface 35, a keyway 36, a plurality of perforations 37, and a plurality of metal blocks 38. In order to improve the appearance of the spacer, a concept of using a polymer material to form the ring structure is developed in this embodiment based on the first embodiment.

In the second embodiment, the spacer body 31 has a ring structure; the ring structure is integrally formed of a polymer (such as plastic steel, ABS, PC, POM, PBT, or any combination thereof). The inner surface 32 is positioned on the inner side of the ring structure, and the outer surface 33 is positioned on the outer side of the ring structure; the inner surface 32 and the outer surface 33 are parallel to each other and both extend along the central axis of the ring structure. The first side surface 34 and the second side surface 35 both extend between the inner surface 32 and the outer surface 33 and are perpendicular to them, wherein the second side surface 35 is opposite to the first side surface 34.

A plurality of perforations 37 are provided on both the first side surface 34 and the second side surface 35. In a preferred embodiment, the perforations 37 on the first side surface 34 and the perforations 37 on the second side surface 35 form a plurality of through-holes (i.e., the through-holes extend through the spacer body from the first side surface 34 to the second side surface 35). The plurality of perforations 37 may be evenly distributed on the spacer body 31, but they are not limited to perforations of identical dimensions. The number and dimensions of the perforations 37 can be adjusted depending on the number and dimensions of the metal blocks provided in them. When the quantity of the metal blocks increases, the volume of each metal block becomes smaller accordingly. In another preferred embodiment, the perforations 37 containing the metal blocks are through-holes that extend from the first side surface 34 to the second side surface 35, and the rest of the perforations 37 may not extend through from the first side surface 34 to the second side surface 35. For example, in FIG. 4, three metal blocks 38 are disposed in three of the perforations 37, and the height of each metal block 38 exceeds the first side surface 34 and the second side surface 35. The metal blocks 38 can sustain the pressure applied to the first side surface 34 and the second side surface 35 and increase the structural strength of the spacer body 31. The inner surface 32 has a keyway 36; the keyway 36 may be made of metal and disposed at any position on the inner surface 32, extending along the central axis of the ring structure.

Figure 5:
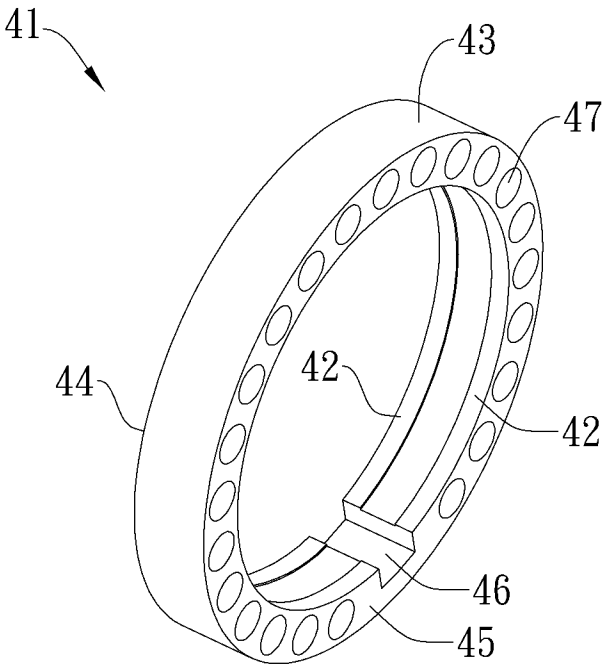
FIG. 5 is a perspective view of a light-weight spacer according to the third embodiment of this invention.

FIG. 5 is a perspective view of a light-weight spacer according to the third embodiment of this invention. A spacer body 41 comprises an inner surface 42, an outer surface 43, a first side surface 44, a second side surface 45, a keyway 46, and a plurality of perforations 47.

The third embodiment of this invention provides a light-weight spacer that is produced with a less complex manufacturing process than those used in the first and second embodiments. The light-weight spacer according to the third embodiment reduces its structural weight by having drilled holes in a conventional spacer as shown in FIG. 2.

In the third embodiment, the spacer body 41 has a ring structure, which may be integrally made of metal or formed by joining/combining metals together (such as medium carbon steel, S45C steel, SCM440 steel, SUJ2 steel, tool steel, stainless steel plate, aluminum alloy steel, or various alloy steels). The inner surface 42 is positioned on the inner side of the ring structure, and the outer surface 43 is positioned on the outer side of the ring structure. The inner surface 42 and the outer surface 43 are parallel to each other and both extend along the central axis of the ring structure. The first side surface 44 and the second side surface 45 both extend between the inner surface 42 and the outer surface 43 and are perpendicular to them, wherein the second side surface 45 is opposite to the first side surface 44.

A plurality of perforations 47 are provided on both the first side surface 44 and the second side surface 45. The perforations 47 on the first side surface 44 and the perforations 47 on the second side surface 45 form a plurality of through-holes (i.e., the through-holes extend through the spacer body from the first side surface 44 to the second side surface 45). The plurality of perforations 47 may be evenly distributed on the spacer body 41, but they are not limited to perforations of identical dimensions. In the third embodiment, the perforations 47 are circular in shape and have identical dimensions. The inner surface 42 has a keyway 46, which may be disposed at any position on the inner surface 42 and extends along the central axis of the ring structure. The perforations 47 closest to the keyway 46 may have larger spacing than the other perforations; this arrangement can prevent a reduction in the structural strength that may occur when the keyway 46 is too close to the perforations 47.

Figure 6:
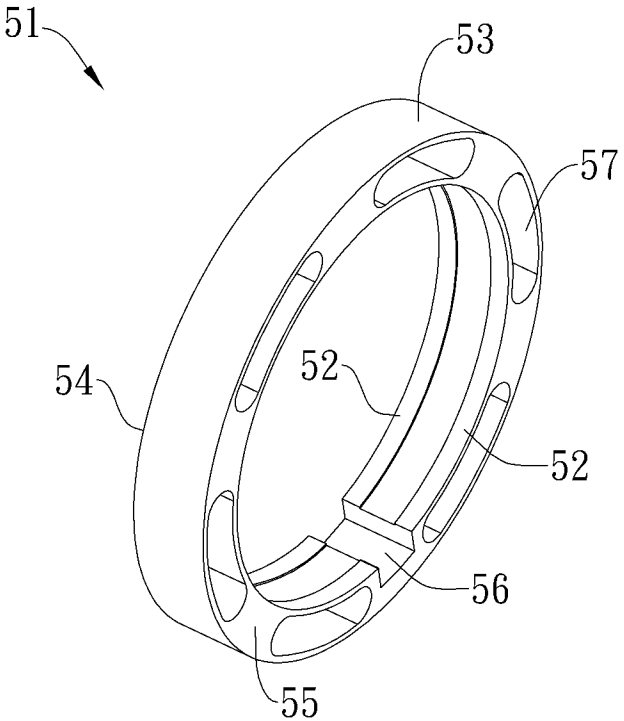
FIG. 6 is a perspective view of a light-weight spacer according to the fourth embodiment of this invention.

FIG. 6 is a perspective view of a light-weight spacer according to the fourth embodiment of this invention. A spacer body 51 comprises an inner surface 52, an outer surface 53, a first side surface 54, a second side surface 55, a keyway 56, and a plurality of perforations 57.

In the fourth embodiment, the inner surface 52, the outer surface 53, the first side surface 54, the second side surface 55 and the keyway 56 are identical to their corresponding elements in the third embodiment. The difference between the fourth embodiment and the third embodiment lies in the number and shape of the perforations 57. The light-weight spacer according to the fourth embodiment improves by making each perforation 57 have a bigger opening in a near-oblong shape, such that the weight of the spacer body 51 can be reduced even more. In addition, the perforations 57 are designed to be arc-shaped. The arc angle of each perforation 57 is the same as that of the ring structure, so that the spacer structure can sustain greater stress.

It can be known from the results of the experiment that if the length of each perforation 57 in the fourth embodiment exceeds 10 cm, the structure of the spacer body 51 will be weakened, and deformation of the spacer body 51 is prone to occur during a heat treatment process. Therefore, if the length of each perforation 57 is less than 10 cm, it is easier to maintain the structural strength.

Figure 7:
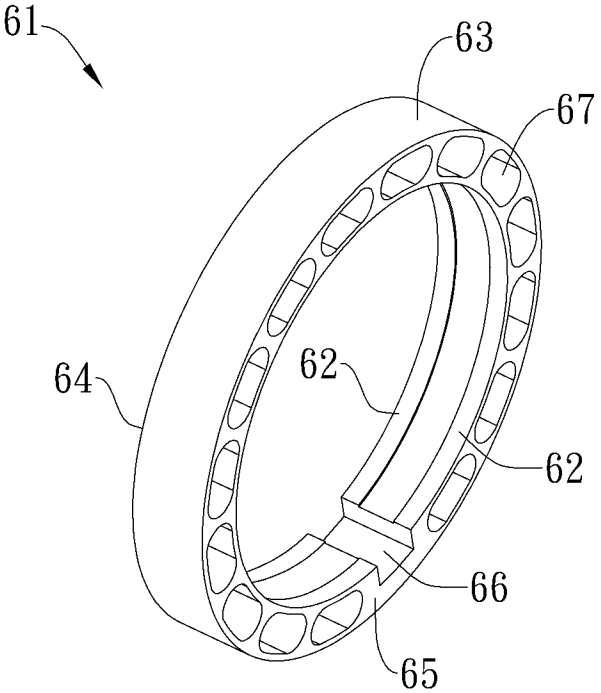
FIG. 7 is a perspective view of a light-weight spacer according to the fifth embodiment of this invention.

FIG. 7 is a perspective view of a light-weight spacer according to the fifth embodiment of the invention. A spacer body 61 comprises an inner surface 62, an outer surface 63, a first side surface 64, a second side surface 65, a keyway 66, and a plurality of perforations 67.

In the fifth embodiment, the inner surface 62, the outer surface 63, the first side surface 64, the second side surface 65, and the keyway 66 are identical to their corresponding elements in the fourth embodiment. The fifth embodiment differs from the fourth embodiment in the number and shape of the perforations 67. The light-weight spacer according to the fifth embodiment improves by making each perforation 67 have a smaller opening which has a shape close to a short oval. Such improvement can increase supporting points between the inner surface 62 and the outer surface 63, so that the structure of the spacer body 61 can be further strengthened. In addition, the design of the perforations 67 maintains an arc-shaped structure similar to that in the fourth embodiment, such that the structural strength of the spacer body 61 can be maintained with its weight being reduced.

Figure 8:
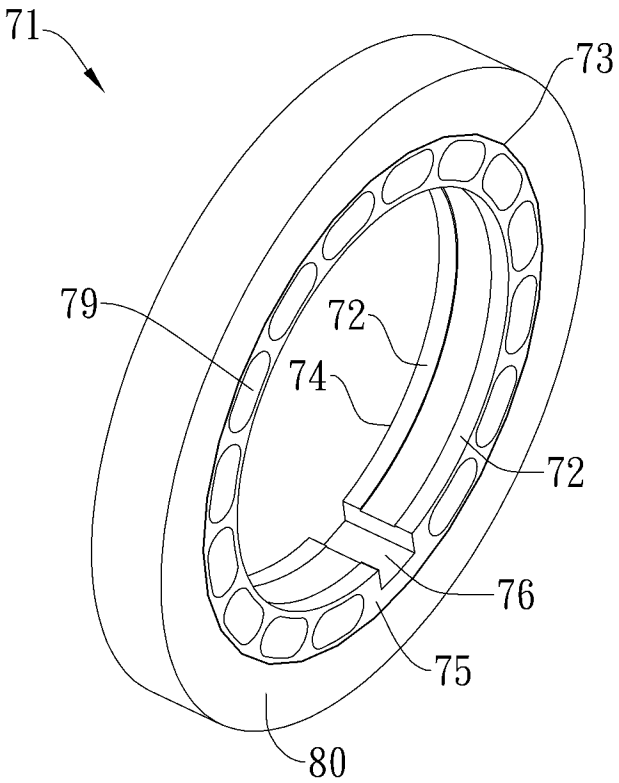
FIG. 8 is a perspective view of a light-weight spacer according to the sixth embodiment of this invention.

FIG. 8 is a perspective view of a light-weight spacer according to the sixth embodiment of the invention. A spacer body 71 comprises an inner surface 72, an outer surface 73, a first side surface 74, a second side surface 75, a keyway 76, a plurality of perforation caps 79, and a plastic ring 80.

In the sixth embodiment, the inner surface 72, the outer surface 73, the first side surface 74, the second side surface 75, and the keyway 76 are identical to their corresponding elements in the fifth embodiment. The sixth embodiment is different from the fifth embodiment in that a plurality of perforation caps 79 are disposed over the plurality of perforations (identical to the perforations 67 in FIG. 7) and that the plastic ring 80 is disposed to wrap around the outer surface 73, wherein the width of the plastic ring 80 is slightly smaller than the width of the outer surface 73. The perforation caps 79 can prevent specks or dust generated during the manufacturing process from entering into the perforations, and can also improve the outlook of the spacer body 71. In this embodiment, the plastic ring 80 wraps around the outer surface 73, and the width of the plastic ring 80 is slightly smaller than that of the outer surface 73. The plastic ring 80 can be used to support the material to be processed and prevent the material from distorting in shape or rolling into the slitting machine.

The perforation caps 79 in the sixth embodiment may be used to cover the perforations in any of the second through fifth embodiments, wherein the perforation caps 79 are designed in accordance with the dimensions of the relevant perforations in order to achieve the effect of preventing specks or dust generated during the manufacturing process from entering into the perforations. The plastic ring 80 in the sixth embodiment may be used to wrap around the outer surface in each of the first through the fifth embodiments, in order to achieve the effect of supporting the material to be processed and preventing the material from distorting in shape or from rolling into the slitting machine.

The perforations described in the foregoing second through sixth embodiments are not limited to circular, oblong, or oval perforations, which are shaped and cut using a CNC machine. The perforations may also be in square, rectangular, oval or other shapes. Meanwhile, an arc design may also be added to the above shapes to achieve the effect of enhancing the support force. Moreover, unlike the perforations described in the foregoing third through sixth embodiments, in another preferred embodiment, the perforations on the spacer are not limited to through-holes that extend through from the first side surface to the second side surface; rather, the perforations on the first side surface and on the second side surface may not be interconnected.

With the light-weight spacer according to the first through sixth embodiments of this invention as described above, the weight of the spacer body can be reduced by 35% to 50% or more, while the precision and structural strength is also maintained.

Preferred embodiments of this invention have been illustrated by the above description and drawings. All the features disclosed in this description may be employed optionally in combination with each other, and every feature disclosed in this description may be replaced selectively with features of the same, equivalent, or similar purpose. Therefore, except for those particularly distinctive features, each of the features disclosed in this description provides merely one example among equivalent or similar features.

Although the above embodiments have been selected to illustrate this invention, those skilled in the art would understand that the present invention may be altered or modified without departing from the scope defined by the following claims. For example, the dimensions, shape, number, position or orientation of the respective elements may be modified depending on needs and/or demands; and two elements which are in contact or connected to each other may have an intermediate member therebetween. It may take two elements to perform the function which one single element can provide, and vice versa. The structure and function disclosed in one embodiment may be adopted in another embodiment, and one particular embodiment does not necessarily have to display all the advantages. Every single feature is unique relative to prior art, and the applicant has also considered situations where one single feature or the combination with other features is employed to further develop this invention, including to embody the structural and/or functional concept with the features described herein. Therefore, the description of the foregoing embodiments of this invention is merely exemplary and shall by no means limit this invention to the scope defined by the attached claims and equivalents thereof.

What is claimed is:

1. A light-weight spacer for a slitting machine for maintaining a width between slitting knives, the light-weight spacer comprising:

a solid spacer body having a ring structure;

an inner surface, positioned on an inner side of the ring structure and extending along a central axis of the ring structure;

an outer surface, positioned on an outer side of the ring structure and extending along the central axis of the ring structure;

a first side surface, extending between the inner surface and the outer surface and being perpendicular to the inner surface and the outer surface;

a second side surface, extending between the inner surface and the outer surface and being opposite to the first side surface;

a first plurality of perforations provided on the first side surface; and a second plurality of perforations provided on the second side surface, wherein the first plurality of perforations and the second plurality of perforations are in a shape of short oval or oval with an arc angle of the shape that is the same as an arc angle of the ring structure, the first plurality of perforations and the second plurality of perforations interconnect and form a plurality of through-holes, the plurality of through-holes extending through from the first side surface to the second side surface such that a pillar formed of a portion of the solid spacer body with two opposite-sided arc surfaces is provided between each pair of the neighboring through-holes, each of the arc surfaces forms a sidewall of one of the through-holes, and wherein the first plurality of perforations and the second plurality of perforations are adapted to reduce a weight of the spacer body by 35% to 50%.

2. The light-weight spacer of claim 1, wherein the ring structure is integrally formed of metal.

3. The light-weight spacer of claim 1, wherein the first plurality of perforations and the second plurality of perforations are evenly distributed on the spacer body.

4. The light-weight spacer of claim 1, further comprising:

a keyway, disposed on the inner surface and extending along the central axis of the ring structure.

5. The light-weight spacer of claim 1, further comprising:

a plastic ring, wrapping around the outer surface and having a width smaller than a width of the outer surface.

6. The light-weight spacer of claim 1, further comprising:

a plurality of perforation caps, disposed over the first plurality of perforations and the second plurality of perforations.

* * * * *